343-754 SR
5/2/78 OR 4,087,821

United States Patent [19]

Phelan

[11] 4,087,821

[45] May 2, 1978

[54] POLARIZATION CONTROLLABLE LENS

[75] Inventor: Harry Richard Phelan, Melbourne, Fla.

[73] Assignee: Harris Corporation, Cleveland, Ohio

[21] Appl. No.: 705,282

[22] Filed: Jul. 14, 1976

[51] Int. Cl.[2] ..... H01Q 1/36

[52] U.S. Cl. ..... 343/754; 343/895

[58] Field of Search ..... 343/895, 754

[56] References Cited

U.S. PATENT DOCUMENTS

| | | | |
|---|---|---|---|
| 3,137,002 | 6/1964 | Kaiser et al. | 343/895 |
| 3,956,752 | 5/1976 | Phelan | 343/895 |

*Primary Examiner*—Eli Lieberman

[57] ABSTRACT

A polarization controllable lens is disclosed for receiving and re-radiating linearly polarized electromagnetic energy. The lens is comprised of a pair of spaced apart multiarm/antenna elements of opposite geometric polarization. The elements are located on opposite sides of a ground plane and are spaced therefrom by ¼ wave length. The arms of the two antenna elements are constructed of different lengths such that the right-hand circular polarized and left-hand circular polarized components of a linearly polarized signal experience different phase delays while being received and then re-radiated. As a result, the linear polarization state of the re-radiated energy is rotated by an amount proportional to such difference in lengths.

10 Claims, 8 Drawing Figures

POLARIZATION CONTROLLABLE LENS

This invention relates to the art of the antennas and, more particularly, to an improved antenna lens structure adapted for use in a lens array and which is particularly applicable for receiving electromagnetic energy of one linear polarization state and re-radiating the energy in a second linear polarization state.

The invention described herein is a variation of the polarization insensitive lens antenna described in U.S. Pat. No. 3,956,752, the contents of which are incorporated herein by reference.

Whereas the invention will be described herein with respect to antenna elements, which each have a plurality of spiral shaped arms, the invention is not limited thereto so long as the arms exhibit a spatial configuration such that when they receive circular polarized energy, signals are developed along the arms which differ in phase from each other.

In many radar and communications systems utilizing linearly polarized signals, it is desirable to have control of the polarization state thereof. Thus, for example, many lens antenna applications require that an invariant polarization be produced in the far field. Due to the characteristic of some feed arrays to produce fields having a linear polarization which varies with azimuthal angle, an antenna lens is necessary that can "twist" the orientation of the linearly polarized signal. By arranging a number of such lenses in an array and structuring each lens to provide the necessary twist associated with the position of that lens in the array, the desired invariant far field can be produced.

It is a specific object of the present invention to provide a polarization controllable lens adapted for use in an array of such lenses for receiving and efficiently re-radiating linear polarized electromagnetic energy.

It is a still further object of the present invention to provide such a lens having two spaced apart elements for respectively receiving and re-radiating electromagnetic energy and wherein the path length for signals received in one element and transmitted to the other element for re-radiation is different for right-hand and left-hand circular polarized signals.

It is a still further object of the present invention to provide such a lens which is constructed with lightweight components such as printed circuits, permitting low cost construction in large volume.

It is a still further object of the present invention to provide such a lens which is small in size and exhibits a low weight characteristic, which is obtained by integrating the phase shift function directly into the lens element.

In accordance with one aspect of the present invention, a polarization controllable lens is provided which serves to receive and re-radiate electromagnetic energy. This lens is comprised of first and second spaced apart antenna elements which serve to respectively receive and re-radiate electromagnetic energy. Each antenna element is comprised of an even pair of electrically conductive spiral arms which are spaced from each other. The arms have a common axis of rotation and each arm has an inner and outer arm end. The inner arm ends are rotationally displaced about the axis relative to each other by a given angle so as to achieve a given rotational phase progression about the common axis. These two antenna elements are of opposite geometric winding sense. Transmission means, including four conductors, serve to connect a respective arm of the first element with an associated arm of the second element. The outer arm ends of the two elements are different in length by a selected amount. The path length of current flow from the receiving element to the radiating element is, therefore, different for left-and right-hand circularly polarized electromagnetic energy. Because of this, the polarization state of linearly polarized electromagnetic energy undergoes a twist in orientation when received and re-radiated by this lens.

DESCRIPTION OF PREFERRED EMBODIMENT

The foregoing and other objects and advantages of the invention will become more readily apparent from the following description of the preferred embodiment of the invention as taken in conjunction with the accompanying drawings, which are a part hereof and wherein.

Figure 1A:
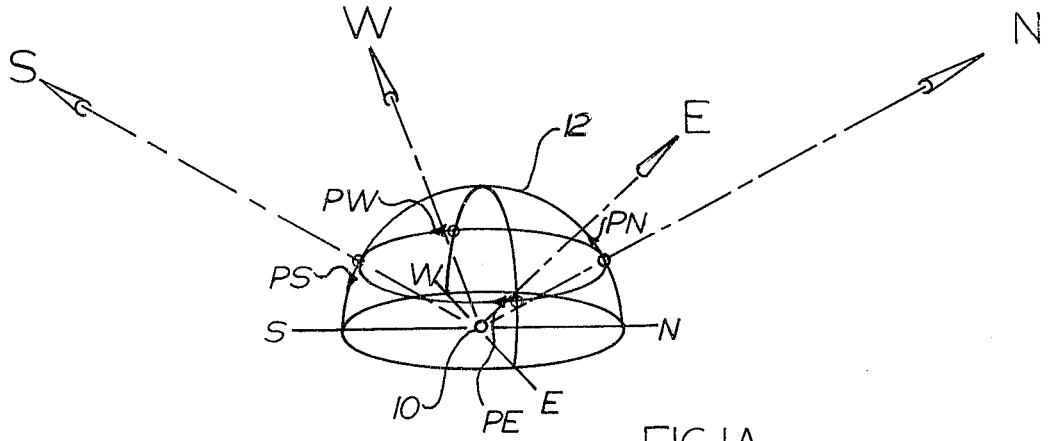
FIGS. 1a and 1b are elevational views illustrating a feed array covered by a dome array of lens cells.

Referring now to the drawings wherein the showings are for purposes of illustrating a preferred embodiment of the invention only and not for purposes of limiting the same, there is illustrated in FIG. 1(a) a feed array FA which produces a pencil beam of linearly polarized electromagnetic energy. The pencil beam may be controllably directed to illuminate any selected portion of a hemispherically shaped dome 12.

Certain feed arrays characteristically produce beams of electromagnetic energy whose linear polarization state, although fixed with respect to a given reference plane, appears to vary with scan angle. For purposes of illustration, the feed array shown in FIG. 1 is depicted as producing a beam of electromagnetic energy whose linear polarization vector is continually directed in a generally north-south direction. Thus, regardless of the direction in which the beam is pointed, the polarization vector will continue to point in a generally north-south direction.

It will be assumed hereinafter that the beam is positioned to follow the motion of an observer as he moves around the dome. When the observer views the dome from the north, the polarization vector PN will appear to be vertically oriented. When the observer moves clockwise around the dome by 90° so as to view the dome from the east, the polarization vector PE will appear to be horizontally oriented. Similar rotations of the linear polarization vector will appear to occur as the observer continues to move around the dome. Although the polarization vector is always pointed in a southerly direction, apparent rotation thereof occurs as the beam is scanned 360° around the dome.

Figure 1B:
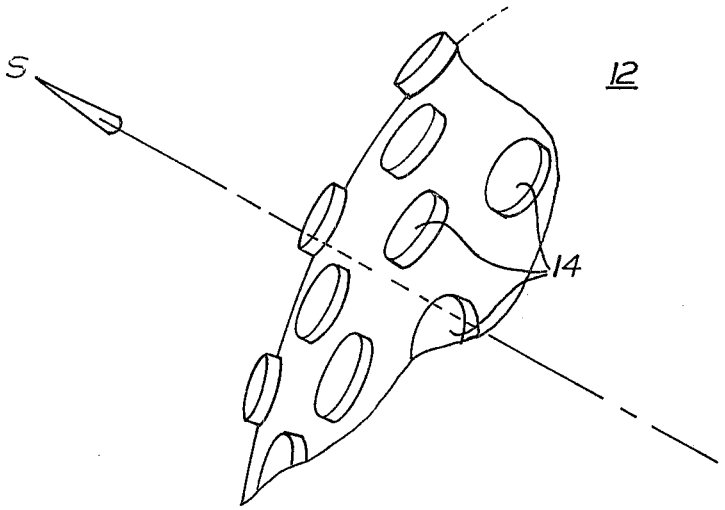

It is desirable in many circumstances to provide a linearly polarized beam whose vector does not rotate in this fashion. As shown in FIG. 1(b), this can be accomplished by covering the dome 12 with a number of spaced lens cells 14 each constructed in accordance with the present invention. In a well-known manner, incident radiation received on one side of the dome will be transmitted through the various lens cells and re-radiated from the opposite side. If the lens cells are each constructed to provide an amount of polarization twist in accordance with the position of that lens cell upon the dome 12, the variations of the linear polarization vector with scan angle can be compensated.

Figure 2:
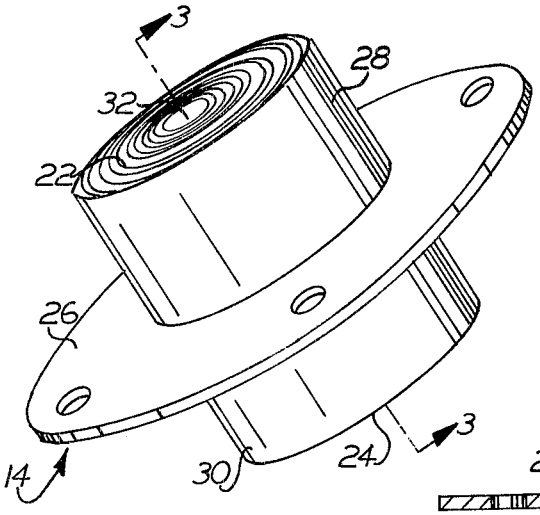
FIG. 2 is a perspective view illustrating the construction of each lens cell.
Figure 3:
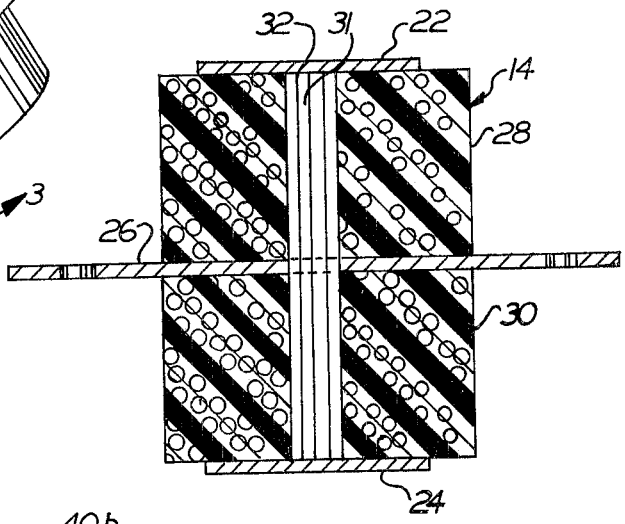
FIG. 3 is a cross-sectional view of a lens cell such as that illustrated in FIG. 2.

Having now generally described one application of the present invention, attention is directed to the antenna lens cell structure employed herein. A lens cell is illustrated in FIGS. 2 and 3 and is comprised of two antenna elements including an element 22 and an element 24 separated from each other and spaced on opposite sides of a conductive member defining a ground plane 26. The antenna elements 22 and 24 each take the form similar to the antenna element illustrated in FIG. 4, to be described in greater detail hereinafter. Such an antenna element is comprised of an even number of arms in excess of two. Preferably it is comprised of a four-arm spiral antenna element wherein the arms of the element are substantially co-planar. As shown in FIGS. 2 and 3, antenna elements 22 and 24 lie in parallel planes each spaced by one quarter wave length from ground plane 26. Each antenna element is supported in spaced relationship from the ground plane by means of a spacer 28 or 30. The spacers are affixed to the ground plane 26 and are constructed of electrical insulating material, such as plastic foam. These spacers may be secured to the ground plane in a suitable manner, such as by an epoxy. Similarly, the spiral antenna elements 22 and 24 are each mounted on a plastic substrate, and which is suitably mounted to blocks 28 and 30, as by a suitable epoxy.

As is best shown in FIG. 2, the lens cell is circular in cross section and is provided with an axial bore 32 which extends through spacers 28 and 30 and ground plane 26 to provide access between antenna elements 22 and 24. A four wire transmission line 31 is located in this bore with each wire connecting a respective inner arm end of one antenna element with an associated inner arm end of the other antenna element. The distance between the two antenna elements is on the order of one half wave length and, consequently, this is the length of the respective transmission lines.

Figure 4:
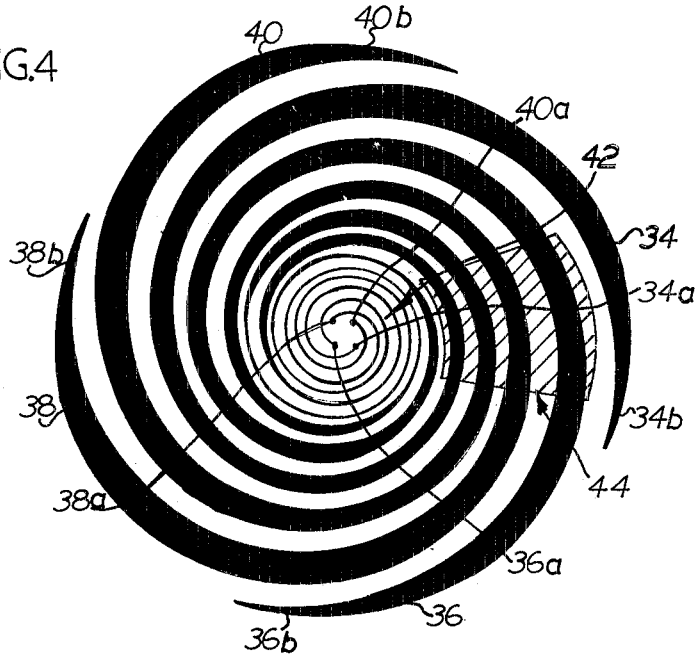
FIG. 4 is an enlarged view showing the construction of each element antenna incorporated in the lens cell.

Reference is now made to FIG. 4 which illustrates the construction of a lens antenna element, such as element 22 or 24. The element shown in FIG. 4 is a spiral antenna element consisting of four spiral arms 34, 36, 38 and 40. The arms may be constructed by printed circuit techniques wherein the four individual arms are conductive copper strips mounted on the surface of a plastic substrate so that the arms are electrically insulated from each other. Each arm is comprised of a combination of an archimedean and logarithmic spiral portions. The inner archimedean portion, generally referred to by the character 42, of each arm extends from the innermost end of the arm and outwardly therefrom in archimedean fashion and terminates into the outer logarithmic portion, generally referred to by the character 44, which continues outwardly until it terminates in an outer arm end. The outer arm ends of arms 34, 36, 38 and 40 are respectively designated by the characters **34*b*, 36*b*, 38*b*, and 40*b*** respectively.

Antenna elements 22 and 24 are incorporated in the lens such that one of the antenna elements serves a receiving function and the other serves a transmitting function. The lens cell is constructed so that the antenna elements 22 and 24 are oppositely wound spirals. This permits the same lens to be employed to receive and efficiently re-radiate electromagnetic energy which may be either left-hand or right-hand circular polarized.

Since the operation of a similar lens is described in extensive detail in U.S. Pat. No. 3,956,752, only an abbreviated operative description of the basic spiral lens will be provided herein.

As set forth in that patent, the beam of electromagnetic energy will induce currents in the spiral arms along an annular ring, a portion of which is indicated in FIG. 4 with reference to a zone 44. This zone is but a portion of the annular ring essentially co-axially disposed about the axis of rotation of the antenna element. This active zone is not sharply defined, instead the sensitivity of the antenna progressively increases with increasing radius and progressively decreases with further increasing radius and has a maximum sensitivity at some mean radius within zone 44.

Referring again to FIG. 3, incident electromagnetic energy that is right-hand polarized will induce currents in the active zone of the receiving element, e.g. element 24, assumed herein to be a left-hand spiral element as seen from the feed side of the lens. These currents will initially flow outward to the outer ends of the spiral arm where they will be reflected back toward the inner arm ends. On the other hand, incident energy which is left-hand polarized will cause currents to be induced in the element arms which will initially flow inwardly from the active zone towards the inner arm ends. Consequently, it will be seen that the currents induced by the right-hand circularly polarized energy will travel a greater distance in reaching the inner arm ends than will the currents induced by left-hand polarized energy. This path difference will be equal to twice the length of the outer arm ends. After reaching the inner arm ends, the currents will flow along the four-wire transmission line 31 to the second antenna element 22 and will commence flowing outwardly along the associated antenna arms toward the active region. The currents induced by right-hand circularly polarized energy will arrive at the active region of re-radiating element 22 in the phase progression required to produce efficient radiation thereof. Currents induced by left-hand circularly polarized energy, on the other hand, will arrive at the active zone in an out-of-phase condition and will, therefore, continue to travel outward along the outer arm ends of the re-radiating element. These currents will then be reflected back toward the inner arm ends, and will reach the active zone of the re-radiating element in the phase progression required to produce efficient radiation thereof. From this it will be seen that left-hand circularly polarized energy will travel along the outer arm ends of the re-radiating element whereas right-hand circularly polarized energy will not.

Figure 5:
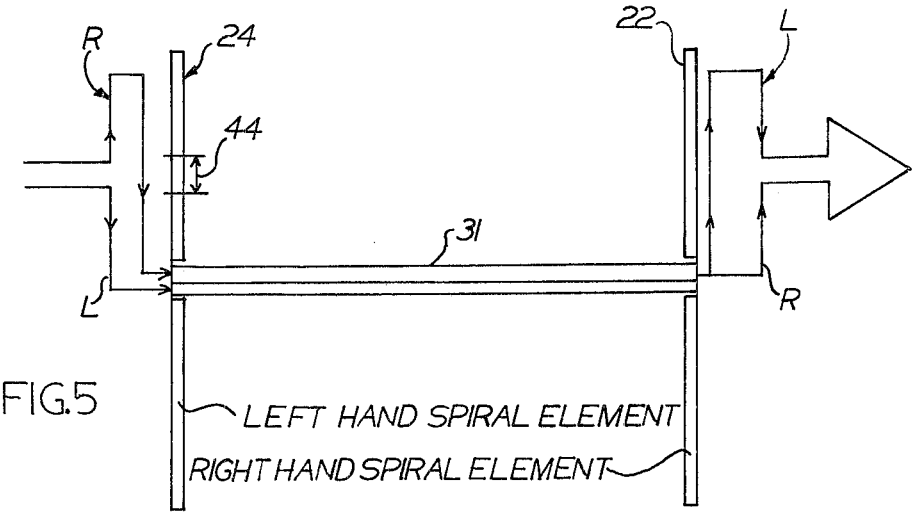
FIG. 5 is a cross-sectional view of a lens cell showing the signal paths for the left-and right-hand circularly polarized components of a linearly polarized signal.

If the receiving element is illustrated with linearly polarized electromagnetic energy, the antenna will separate that energy into its component left-and right-hand circular polarizations. These components will follow the signal paths outlined above, and graphically depicted in cross-section in FIG. 5. If the outer arm ends of the receiving and re-radiating elements are the same length, then the excessive length traveled by the right-hand circularly polarized signals in the receiving element will be substantially the same as the excessive length traveled by the left-hand circularly polarized signals in the re-radiating element. Since the left-and right-hand polarized signals will travel along paths of substantially the same length before being re-radiating, the left-and right-hand circularly polarized signals will be re-radiated with substantially the same phase relationship therebetween as when they were received. Consequently, the re-radiated signal will be linearly polarized and will have the same linear polarization state as the received signal.

The present invention contemplates varying the length of the outer arm ends of either one or both of the elements in the individual lens cells. This will introduce a corresponding difference in the path lengths traveled by the component left-and right-hand polarizations of a linearly polarized signal. Because of this path length difference, the left-and right-hand components will be recombined with a changed phase relationship therebetween, producing a twist in the orientation of the resultant linearly polarized signal. The path difference will be approximately equal to twice the added or subtracted outer arm length. This path difference, when expressed in fractions of a wavelength times 360° (or $2\pi$), corresponds to the difference between the insertion phases for the two circular polarizations. The amount of rotation of the linear polarization vector will be equal to one-half this insertion phase difference.

Figure 6:
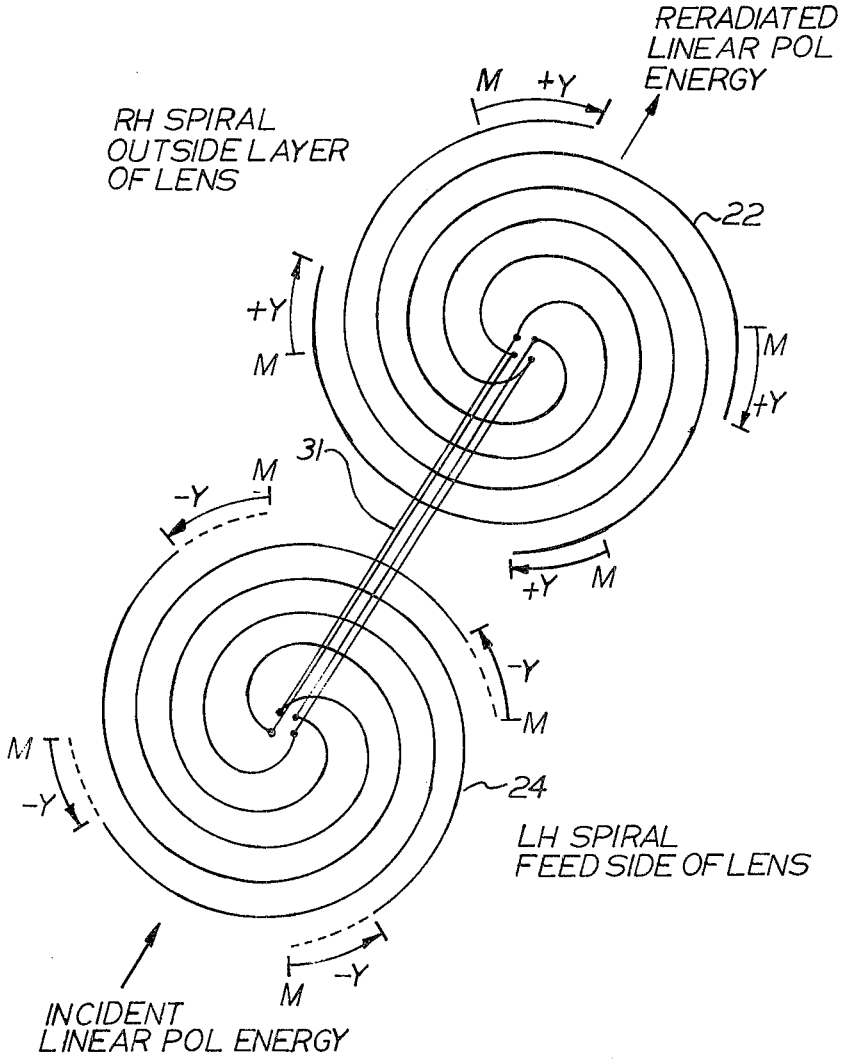
FIG. 6 is a simplified illustration of the lens cell of FIGS. 2–4, altered in accordance with the teachings of the present invention; and, FIG. 7 is a graph of the polarization and phase shifts with respect to changes in outer arm line length.

FIG. 6 is a simplified illustration of a lens cell which has been altered to provide the desired twist in orientation of received and re-radiated linearly polarized electromagnetic energy. The geometry of the spiral arms has been simply pictured by lines for ease of illustration; the arms preferably have the structure described hereinbefore with reference to FIG. 4, each having both archimedian and logarithmic portions. The letter M indicates the length that the arms in each element would be given if no linear polarization twisting were desired. If, as pictured, the receiving element 24 is constructed so that each of the arms therein is shortened at its outer arm end by the amount Y, while the spiral arms of the re-radiating element 22 are lengthened by the amount Y, then the total resulting difference in path length for the two circular polarizations will be 4Y. The two circular polarized components of a linearly polarized signal of wavelength $\lambda$ will therefore experience insertion phases which are different by the amount $(4Y/\lambda)360°$, producing a twist in orientation of the linearly polarized signal by $(2Y/\lambda)360°$.

As previously mentioned, this twist can be produced by changing the outer arm line length of either one or both of the elements, the important feature being the path difference resulting thereby.

Figure 7:
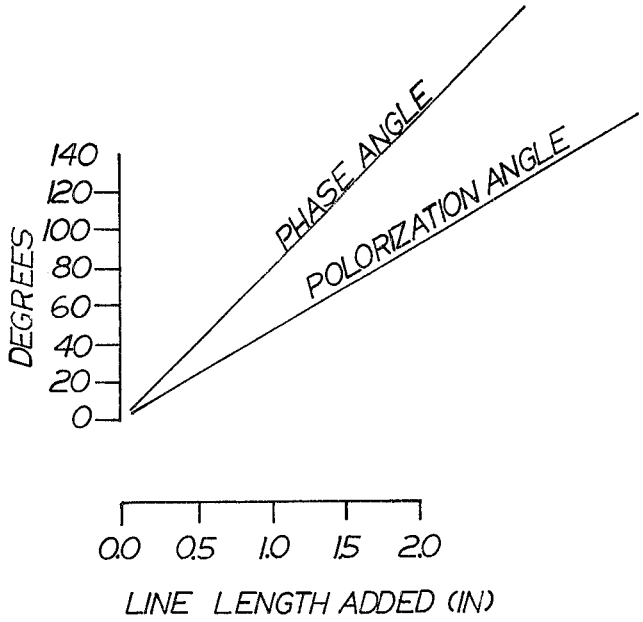

By varying the lengths of the outer arm ends of the two elements, the phase of the re-radiated linear signal may also be varied. This phase shift arises because the phase shift and polarization twist are both equal to one-half the insertion phase difference between the two circular polarizations. FIG. 7 is a graphic representation of the experimentally determined relation between the difference in length of the outer arm ends and the resulting phase and polarization shifts. It will be noted that, although the phase shift and polarization do not agree exactly, there is a definite linear relationship between the two and thus the phase shift can be taken into account.

From the foregoing, it will be appreciated that a lens antenna has been described having both polarization and phase control features.

Although the invention has been described with respect to a preferred embodiment, it will be understood that various modifications and arrangements of parts may be made without departing from the spirit and scope of the invention as defined by the appended claims.

What is claimed is:

1. An antenna lens for receiving and re-radiating electromagnetic energy comprising:

first and second spaced apart antenna elements for respectively receiving and re-radiating electromagnetic energy;

Each said element comprising an even pair of electrically conductive spiral arms spaced from each other, said arms having a common axis of rotation, each said arm having inner and outer arm ends, said inner arm ends being rotationally displaced about said axis relative to each other by a given angle to achieve a given rotational phase progression about said common axis;

said first and second antenna elements being of opposite geometric winding sense;

transmission means including a plurality of conductors each interconnecting a said arm of said first element with an associated arm of said second element; and wherein, said outer arm ends of said first antenna element are different in length by a selected amount than said outer arm ends of said second antenna element whereby linearly polarized electromagnetic energy received and re-radiated by said lens experiences phase and polarization shifts substantially proportional to said selected amount.

2. An antenna lens as set forth in claim 1 wherein said transmission means is on the order of one-half wave length.

3. An antenna lens as set forth in claim 1 including means defining a ground plane interposed between said first and second antenna elements.

4. An antenna lens as set forth in claim 3, wherein said ground plane is located approximately one-quarter wave length from each said element.

5. An antenna lens as set forth in claim 1, wherein said plurality of arms of each said antenna element define a coplanar structure.

6. An antenna lens as set forth in claim 1, wherein each said conductor interconnects an inner arm end of said first element with an inner arm end of an associated arm of said second element.

7. An antenna lens as set forth in claim 1 wherein each said antenna element is comprised of said conductive arms which are configured so as to have an archimedean portion and a logarithmic portion.

8. An antenna lens as set forth in claim 7 wherein archimedean portion of each said arm extends from said inner end outwardly and terminates into said logarithmic portion.

9. An antenna lens as set forth in claim 1, wherein said even number of pairs of said conductive arms includes four conductive arms, said arms being of like configuration.

10. An antenna lens as set forth in claim 9, wherein said inner arm ends are rotationally displaced about said axis relative to each other by 90° so as to achieve a rotational phase progression of 0°, 90°, 180° and 270°.

* * * * *